US007258761B2

(12) United States Patent
Liu et al.

(10) Patent No.: US 7,258,761 B2
(45) Date of Patent: Aug. 21, 2007

(54) MULTI-STEP PREHEATING PROCESSES FOR MANUFACTURING WOOD BASED COMPOSITES

(75) Inventors: Feipeng Liu, Statham, GA (US); Joel Barker, Townville, SC (US)

(73) Assignee: Huber Engineered Woods LLC, Charlotte, NC (US)

( * ) Notice: Subject to any disclaimer, the term of this patent is extended or adjusted under 35 U.S.C. 154(b) by 383 days.

(21) Appl. No.: 10/987,820

(22) Filed: Nov. 12, 2004

(65) Prior Publication Data

US 2006/0102278 A1 May 18, 2006

(51) Int. Cl.
*D21J 1/04* (2006.01)

(52) U.S. Cl. ..... 156/296; 156/580; 156/583.5; 264/102; 264/112; 425/371

(58) Field of Classification Search ..... None
See application file for complete search history.

(56) References Cited

U.S. PATENT DOCUMENTS 5,063,010 A * 11/1991 Fischer et al. ..... 264/109
5,433,905 A * 7/1995 Tisch ..... 264/83
5,658,407 A * 8/1997 Thorbjornsson ..... 156/62.2
5,733,396 A 3/1998 Gerhardt et al.
5,756,975 A 5/1998 Harris et al.
5,762,980 A 6/1998 Bielfeldt
5,913,990 A 6/1999 Kramer
6,080,344 A 6/2000 Thorbjornsson
6,098,679 A 8/2000 Go et al.
6,123,884 A 9/2000 Lundgren et al.
6,136,329 A 10/2000 Boratyn
6,533,889 B2 3/2003 Dueholm
2003/0064230 A1 * 4/2003 Liu et al. ..... 428/425.1

FOREIGN PATENT DOCUMENTS

WO WO99/24233 A1 5/1999

* cited by examiner

*Primary Examiner*—Sam Chuan Yao
(74) *Attorney, Agent, or Firm*—David Mitchell Goodrich; Carlos Nieves; Patricia Ades

(57) ABSTRACT

A method for the production of a wood composite board is provided that comprises the steps of: providing a quantity of wood in the form of strands; coating the wood strands with a binder composition to from coated strands; forming a mat from the coated strands; exposing said mat to steam; ventilating steam; and pressing the mat, at a high temperature, to form the wood composite board having a final thickness.

12 Claims, No Drawings

MULTI-STEP PREHEATING PROCESSES FOR MANUFACTURING WOOD BASED COMPOSITES

BACKGROUND OF THE INVENTION

Wood can be used to construct almost any part of a home from the roofing and exterior walls to the floor and interior architectural elements as well as basic domestic items like furniture and cabinets. However, in recent years the cost of solid timber wood has increased dramatically as its supply shrinks due to the gradual depletion of old-growth and virgin forests.

Accordingly, because of both the cost of high-grade timber wood as well as a heightened emphasis on conserving natural resources, wood-based composite materials alternatives to natural solid wood lumber have been developed that make more efficient use of harvested wood and reduce the amount of wood discarded as scrap. Plywood, oriented strand board ("OSB"), laminated veneer lumber (LVL), parallel strand lumber (PSL), and laminated strand lumber (LSL), and oriented strand lumber (OSL), are examples of wood-based composite alternatives to natural solid wood lumber that have replaced natural solid wood lumber in many structural applications in the last seventy-five years.

Pressed boards and wood composite materials are manufactured by mixing wood and one or more additives, such as adhesives and waxes. During manufacture, the wood-additive mixture is first laid down in batches on a conveyor belt in a loose mat, and this loose mat is then simultaneously compressed and heated. Heating the mat cures the binder and waxes present in the wood-additive mixture as well as evaporates the moisture present in the raw materials, while simultaneously, by the action of compression, the wood and additive materials are fused together to form a consolidated wood board.

Compression of the wood and wood-additives into a wood composite material may occur in either a multi-platen press where several batches of wood and wood additives are set upon a series of press platens, and the batches compressed between adjoining platens, or in a continuous process, where a wood composite material is made by continuously moving a wood and wood additive mat between two heated steel belts that apply pressure to the mat to from a billet or sheet of wood composite material that is then cut into a predetermined length to form boards of a manageable size.

It has been previously noted that in the compression of the wood composite material by either of the aforementioned methods, that preheating the mat of wood and wood additive material with steam can dramatically reduce the press time, which is the amount of time necessary for the adhesive to set or "cure" within the wood composite board to give the board its coherency and strength and to consolidate the material into a wood composite board. U.S. Pat. No. 5,733,396 discloses preheating a particle or wood strand mat to a temperature of less than 100° C. with a mixture of superheated steam and hot air. The steam/hot air mixture provides moisture to soften the wood fibers and enhance lignin flow in the mat. Preheating with steam/hot air is especially effective with polymeric resin such as isocyanate adhesives and resins because isocyanates readily react with water, hydroxyl, and other functional groups found in lingo-cellulosic materials. Further advantages include reduction in the amount of volatile organic compound ("VOC") emissions because of the mild press parameters (e.g., pressure, exposure time and temperature).

Unfortunately, several problems concurrent with the usage of steam preheating step have been observed, especially for panels having a final pressed thickness of greater than 1 inch. The most common of these problems in wood composite panels include blistering, carbonizing, surface pitting, delaminating, and warping. All of these aforementioned imperfections can all be traced to aspects of the preheating process. For example, blistering on both the panel surface and interior occurs as a result of non-uniform moisture condensation, incomplete steam penetration, and a sudden reaction between an isocyanate resin (particularly "MDI" which is discussed in greater detail below) and water vapor which are due all or in part to the steam preheating step. Surface pitting is similarly caused by a steam preheating step, as a result of the impact of the steam flow injected at high pressure towards the panel. Additionally, other defects such as a large degree of warping and thickness swelling have been noticed, especially in wood strand lumber products with uni-directional laminated strands.

Other processing strategies, modifications or requirements have been developed to avoid the aforementioned imperfections. For example, in order to avoid blistering and carbonization, it is necessary to use lower press temperatures that require longer pressing cycles to ensure proper composite consolidation. Use of steam preheating can create a need for a prolonged de-gassing step in order to obtain products that meet the performance requirements and avoid blows and delaminations, especially for wood strand lumber products using long strands. Furnish moisture content has to be tightly controlled in the manufacturing process with a narrow tolerance. Often, special manufacturing adjustments/change have to be made. In order to implement such manufacturing changes, it is necessary to install special processing technology and equipment changes to simultaneously reduce the press cycle time while also maintaining the high quality of the wood composite materials. Such process adjustments not only increase production costs, but also reduce the quantity and quality of wood composite materials that can be manufactured.

Given the foregoing there is a continuing need for an apparatus and method for producing composite wood products whereby the benefits of steam preheating may be obtained without reducing the throughput, and undermining the quality of the wood composite materials that are manufactured.

BRIEF SUMMARY OF THE INVENTION

The present invention includes a method for the production of a wood composite board including the steps of: providing a quantity of wood in the form of strands; coating the wood strands with a binder composition to from coated strands; forming a mat from the coated strands; exposing said mat to steam; ventilating steam; and pressing the mat, at a high temperature, to form the wood composite board having a final thickness.

DETAILED DESCRIPTION OF THE INVENTION

All parts, percentages and ratios used herein are expressed by weight unless otherwise specified. All documents cited herein are incorporated by reference.

As used herein, "wood" is intended to mean a cellular structure, having cell walls composed of cellulose and hemicellulose fibers bonded together by lignin polymer.

By "wood composite material" it is meant a composite material that comprises wood and one or more wood composite additives, such as adhesives or waxes. The wood is typically in the form of veneers, flakes, strands, wafers, particles, and chips. Non-limiting examples of wood composite materials include oriented strand board ("OSB"), waferboard, particle board, chipboard, medium-density fiberboard, plywood, parallel strand lumber, oriented strand lumber, and laminated strand lumbers. Common characteristics of the wood composite materials are that they are composite materials comprised of strands and veneers bonded with polymeric resin and other special additives. As used herein, "flakes", "strands", "chips", "particles", and "wafers" are considered equivalent to one another and are used interchangeably. A non-exclusive description of wood composite materials may be found in the Supplement Volume to the Kirk-Rothmer Encyclopedia of Chemical Technology, pp 765-810, $6^{th}$ Edition.

The present invention is directed to a manufacturing process for making wood composite boards. In the process, a mat is formed from wood strands and binder material, and the mat exposed to steam, which softens the wood fibers, enhancing lignin flow, reducing curing time. Unfortunately, as discussed above, this steam preheating step can also produce certain defects. For example blistering, carbonizing, surface pitting, delaminating, and warping, have been noticed in boards exposed to steam.

By the present invention a new technique has been developed to prepare boards without producing these defects, while at the same time not compromising the rate at which the boards can be manufactured nor their quality. This technique involves adding one additional ventilation/vacuum evacuation step after the conventional two step preheating processes (the two steps being pre-compression/compact and steam injection). This ventilation/vacuum evacuation step removes condensed water and entrapped air in the mats that formed during the steam pre-heating stage, thus eliminating the defects associated with condensed water and entrapped air.

Preferably, the wood composite component is made from OSB/OSL material. The OSB/OSL products are derived from a starting material that is naturally occurring hard or soft woods, singularly or mixed, whether such wood is dry (having a moisture content of between 1 wt % and 25 wt %) or green (having a moisture content of between 25 wt % and 200 wt %). Typical moisture content will be about 1 to about 20%, preferably, about 6% to about 15% for face layers for regular OSB, and about 3 to about 12% for core layer. For OSL products, the moisture level is about 2 to about 12%, preferably about 4 to about 7%. Typically, the raw wood starting materials, either virgin or reclaimed, are cut into strands, wafers or flakes of desired size and shape, which are well known to one of ordinary skill in the art.

After the strands are cut they are dried in an oven and then coated with a desired amount of one or more polymeric thermosetting binder resins, waxes and other additives. The binder resin and the other various additives that are applied to the wood materials are referred to herein as a coating, even though the binder and additives may be in the form of small particles, such as atomized particles or solid particles, which do not form a continuous coating upon the wood material. Conventionally, the binder, wax and any other additives are applied to the wood materials by one or more spraying, blending or mixing techniques, a preferred technique is to spray the wax, resin and other additives upon the wood strands as the strands are tumbled in a drum blender.

After being coated and treated with the desired coating polymeric binders and other chemical additives, these coated strands are used to form either single layered unidirectional wood strand/veneer or a multi-layered mat, preferably a single layer mat for laminated strand lumber type products or a three layered mat for regular OSB products. In the single layered mat, multi-orienters can be used to create layered mats with all strands aligned unidirectionally. For example, preferred oriented strand lumber products will include using nominal strand size in length less than 8" and using aspen or other similar species, such as described in U.S. Pat. No. 4,751,131 to Barnes. For multi-layered products, the layering of strands may be done in the following fashion. The coated flakes are spread on a conveyor belt to provide a first ply or layer having flakes oriented substantially in line, or parallel, to the conveyor belt, then a second ply is deposited on the first ply, with the flakes of the second ply oriented substantially perpendicular to the conveyor belt. Finally, a third ply having flakes oriented substantially in line with the conveyor belt, similar to the first ply, is deposited on the second ply such that plies built-up in this manner have flakes oriented generally perpendicular to a neighboring ply. Alternatively, but less preferably, all plies can have strands oriented in random directions. The multiple plies or layers can be deposited using generally known multi-pass techniques and strand orienter equipment. In the case of a three ply or three layered mat, the first and third plys are surface layers, while the second ply is a core layer. The surface layers each have an exterior face. More commonly, four layer orienters are installed in the manufacturing process and manufactured with two face layers and two core layers.

The above example may also be done in different relative directions, so that the first ply has flakes oriented substantially perpendicular to conveyor belt, then a second ply is deposited on the first ply, with the flakes of the second ply oriented substantially parallel to the conveyor belt. Finally, a third ply having flakes oriented substantially perpendicular with the conveyor belt, similar to the first ply, is deposited on the second ply.

Various polymeric resins, preferably thermosetting resins, may be employed as binders for the wood flakes or strands. Suitable polymeric binders include isocyanate resin, urea-formaldehyde, polyvinyl acetate ("PVA"), phenol formaldehyde, melamine formaldehyde, melamine urea formaldehyde ("MUF") and the co-polymers thereof. Isocyanates are the preferred binders, and preferably the isocyanates are selected from the diphenylmethane-p,p'-diisocyanate group of polymers, which have NCO-functional groups that can react with other organic groups to form polymer groups such as polyurea (—NCON—), and polyurethane, (—NCOO—); a binder with about 50 wt % 4,4-diphenylmethane diisocyanate ("MDI") or in a mixture with other isocyanate oligomers ("pMDI") is preferred. A suitable commercial pMDI product is Rubinate 1840 available from Huntsman, Salt Lake City, Utah, and Mondur 541 available from Bayer Corporation, North America, of Pittsburgh, Pa. Suitable commercial MUF binders are the LS 2358 and LS 2250 products from the Dynea Corporation.

The binder loading level is about 2 wt % to 15 wt %, preferably about 3 wt % to about 8 wt %, more preferably about 4 wt % to about 6 wt % of the weight of the oven-dried wood strands. A wax additive is commonly employed to enhance the resistance of the OSB panels to moisture absorption and penetration. Preferred waxes are slack wax, emulsion wax or a combination of both. The wax solids loading level is preferably in the range of about 0.1 wt % to about 3.0 wt % (based on the oven-dried wood weight).

It is preferable that the surface layers in the present invention make use of the following enhanced resin composition. This resin composition involves the simultaneous application of an isocyanate resin and a powdered aromatic phenol-aldehyde thermoset material in the same blender in the preparation of the surface layers of the OSB. The powdered aromatic aldehyde thermoset effectively replaces a fraction of the MDI resin that otherwise would be needed. Preferably, a powdered phenol-formaldehyde is used that can tumble and attach to both the surface of rough strands and the inside of curled flakes used for the surface layer or layers of the OSB. It also enhances resin distribution inside the curled flakes in the surface layer of OSB to improve the board product quality by reducing curled flake failures without increasing resin costs. The MDI binder ingredient renders the OSB structurally strong and durable and generally improves the water resistance, while the phenol-formaldehyde ingredient prevents flake popping, orange peeling and improves strength of the OSB among other things. The resin binder system used for one or both the OSB surface layers, as initially reacted, preferably is non-aqueous and contains no water or, at most, only nominal impurity levels (viz.,less than 1 wt. % and preferably less than 0.5 wt. % water based on the total weight of the binder system). This resin composition and its methods for use are described in greater detail in U.S. Pat. No. 6,479,127.

Preferred single layer oriented strand lumber composites will have a density of 35 to 50 pcf with a preferred strand nominal length of 4" to less then 8". Preferably the resulting wood composite material, especially in the form of OSB, will have a density in the range of about 35 lbs/ft$^3$ to about 50 lbs/ft$^3$-. The density ranges from 35 lbs/ft$^3$ to 50 lbs/ft$^3$ for pine species such as Loblolly pine, Virginia Pine, slash pine, Short leaf pine, and long leaf pines, and 30 lbs lbs/ft$^3$ to 50 lbs/ft$^3$ for Aspen or other similar hardwood species. The thickness of panels (either having a single layer or multi-layers) will be from about ¼ inch (about 0.6 cm) to about 5.5 inch (about 14 cm), preferably about 1.5 inch to about 3.5 inch, more preferably about 1.75 inch to about 2.5 inch.

The wood composite material was then formed and pressed in a press, such as a continuous press, in which a mat formed of wood material and adhesive is continuously fed between two parallel steel belts passing around rollers.

First, a mat of wood material is brought to the press on a conveyor, the conveyor preferably being coated with a release agent to facilitate the releasing of the board from the press without delamination or blistering. The mat is made from one or more layers of wood strands, flakes, particles or chips that are coated with additives like resin binder or wax; the strands may be placed on the mat as discussed above, with adjacent layers having strands oriented perpendicular with respect to another. The height of the mat of wood material should be from about 2 inches to about 30 inches, depending on the target thickness of the wood composite board.

The mat is loaded or passes into a prepress and then compressed to about 110% to about 300% the thickness of the final wood composite sheet material produced in the process. Thus, if the final sheet is to have a thickness of 1 inch, the prepress will compress the mat to a height of between 1.1 inches and 3 inches.

After prepress, and prior to being charged into the continuous press, the mats are exposed to steam treatment by steam sources. The steam sources may be positioned on opposite sides of the mat. In the preferred embodiment, the conveyor will be made of porous wire material so that steam can penetrate through the bottom of the mat. The amount of steam may vary depending on wood species, binder, thickness and density of the mat and desired line speed, or the desired characteristics of the end product. It is expected that in most applications the steam will increase the temperature in the mat to a target of from about 30° C. to about 110° C. After the preheating step, the preheated mats are fed into either multi-opening press or continuous press such as contiRoll® press available from Siempelkamp Maschinen- und Anlagenbau GmbH & Co. or Maschinenfabrik J. Dieffenbacher GmbH & Co., Germany. In a continuous press, the steel belts are maintained at a temperature in the range of range of 200° C. to 240° C. with multi-step heating section/zones. The temperature employed in the press can vary depending on the application and properties of the wood composite materials to be produced, as well as the time period needed to traverse the press. It should be apparent to those skilled in the art that varying the pressure and/or residence time in the press can vary the temperature to achieve similar end product results.

In addition to increasing the board temperature, the steam exposure will also increase the moisture content in the mat from about 0.5% to about 5%. The steam should be injected at the target height of the pre-pressed mats, at the time that the mats have obtained a density of about 15 to about 20 pcf. Preferably the steam is injected at a pressure is about 25 psi to about 500 psi, such as about 30 psi to about 150 psi, such as about 30 psi to about 80 psi. Hot air can be mixed with steam in the a pre-heating chambers, as described for example in U.S. Pat. No. 5,733,396 and in article by Andreas Wostheinrich as found in the 35$^{th}$ International Particleboard and Composite Materials Symposiun).

After steam injection, the steam is ventilated or vacuum-evacuated immediately after the injection, before closing the press. Several different methods of delivering and evacuating the steam may be considered. For example, the loosely formed mats can be loaded or formed on a wire mesh or screen and the mats then (optionally) subjected to a "pre-pressing" step pressed prior to the heating steps in order to process the mats into denser mats. Then steam (also suitable is superheated steam) is injected through the wire mesh screen from above or below the mat, wherein the steam or superheated steam may react with the thermosetting resin to accelerate the rate at which the resin cures.

This ventilation may continue through and be simultaneous with the subsequent pressing steps until the actual step of pressing the wood mats either between adjacent heated press platens or between moving, heated conveyors is reached and "cooking" of the mat material begins (see below).

The mats are charged into the continuous press to produce sheets of a wood composite material or wood boards. The continuous press can be similar to those described in U.S. Pat. Nos. 5,520,530, 5,538,676, and 5,596,924; however, a wide variety of continuous presses can be used in the practice of this invention. The continuous press will typically have a pair of closely spaced, opposing conveyors, and internal, heated press platens which can be progressively and repetitively moved toward each other. Instead of heated press platens, one moveable platen or "ram" and one stationary platen can be used. The heated press platens are responsible for exerting a pressure on the mat material at a temperature at which both platens cure the resin binder and fuses the wood and binder together. The press platens will typically move closer together than the gap between the opposing conveyors, and the distance between the press platens can be varied to accommodate the production of oriented strand board or other engineered composite products such as oriented strand lumber products of differing thicknesses.

The pressure exerted by the press platens can be varied in a similar manner to the temperature. In most applications in the practice of this invention the maximum pressure will range from about 300 to about 1000 psi specific face pressure on the mat. Likewise, the residence time in the press can be varied and is dependent on the length of the press, the speed of the conveyor, and the thickness of the panel. In most applications in the practice of this invention the residence time will range from about 2 minutes to about 15 minutes with a target density of panels of about 32 pcf to about 48 pcf.

It has previously been noted that during this stage in the process of manufacturing wood-based composite materials, there is a build-up of a variety of gas components such as volatile organic compounds (produced by heating the organic resin material and from wood extractives), as well as carbon dioxide, and other gaseous components, between closed press platens (or adjacent moving conveyors in the case of a continuous press). The pressure produced as the result of these entrapped gases is further increased by the high temperatures used during pressing. These notably high gas pressures are particularly severe with respect to certain products such as OSL products and thicker, aspen-based OSB panels that have a unidirectional alignment. As is discussed above, this build-up of gas pressure can cause several different problems in wood composite panels especially warping, thickness swelling, blows and delamination. However, by the present invention the occurrence of these defects is reduced or eliminated by the addition of a ventilation/evacuation step as part of the preheating step, which prevents the pressure build-up that causes these defects to occur in later stages of the process.

Alternatively, instead of a continuous press, the press can be a multi-platen press in which a head platen is mounted above a bed platen, which can be raised and lowered by conventional hydraulic equipment capable of generating the required pressures. Each of these platens can be heated by passing, through the aid of pumping means, a heating fluid through the platen, such as through a series of conduits and channels that are constructed within the platen. Between the head platen and bed platen are multiple press platens that are positioned adjacent to and equally-spaced relative to each other and are operated by an automatic opening and closing mechanism and device. The mats are charged into the continuous press onto press platens where the mats are compressed to produce sheets of a wood composite material or wood boards, and then loaded into a discharge apparatus for emptying the sheets formed on the platens. The manufacturing process is otherwise the same as described above for a continuous press.

The invention will now be described in more detail with respect to the following, specific, non-limiting examples.

EXAMPLES

Wood composite boards were prepared both according to prior art processes and the processes disclosed in the present invention to show that a process practiced according to the present invention can effectively reduce the internal gas pressure during a hot pressing operation. The Examples were prepared according to the following schedule: in Example 1 (prior art), mats with strands in an unidirectional alignment are pressed in a two step pre-heating/pressing procedure (compression and steam injection) and then, with regular hot pressing schedule; while in Example 2 mats with strands in an unidirectional alignment are pressed with a three step pre-heating/pressing schedule (compression, preheating, and ventilation/vacuum evacuation press), and then a regular hot pressing schedule.

Example 1 (Prior Art)

In this example, composite boards were formed from Aspen (Hardwood) species, the composites being pressed and manufactured according to the prior art, with a two step pre-heating/pressing procedure (compression and steam injection). The composite boards were formed from Aspen species having nominal strand dimensions of 5.75 "×0.75 "×0.030" using a commercially available disk strander. Fine components were screened out. The total yield of useful strands is about 97%. The aspen strands were then dried to target moisture content of 7%, and coated with separate spray applications of 5.5 wt % MDI resin and 1.5 wt % emulsion wax (58% concentration, by solids). The strands were aligned using a disk orienter to form a mat wherein the strands are aligned, for ease of experimentation, in a single direction (the machine direction) in a single layer. (The target final dimensions of the pressed board_to be prepared from this mat is 45 pcf with a dimension of 5 '×9 '×1.75"). Then, 1.5 g/ft$^2$ commercially available release agents (specifically, the Black Hawk BSP EX55 product) are sprayed on top and bottom screens contacting the mat. Two PressMan® hot press probes (available from the Alberta Research Council, Edmonton, Alberta) are placed in the panel center to monitor the internal gas pressure of pressed panels during pre-heating and subsequently hot pressing. The strands were then pressed into wood composite boards using a laboratory scale press having top and bottom screens according to the pre-heating and pressing schedule listed in Table I, below.

TABLE I

| Elapsed Time (seconds) | Description | Steam Injection/Ventilation |
|---|---|---|
| 10 | mat of wood composite material having height of 12.5 inches is formed | — |
| 38 | steam is injected | Injection at 30 psi |
| 5 | Press opened to 7 inches | — |
| 24 | Press closing | — |
| 660 | Cooking Panels in Press at 200° C. | — |
| 60 | Degas | — |

As appropriate for prior art technology, no ventilation step was used. Using sensors inserted into the wood material, the highest core layer internal gas pressure for the pressed panels was about 20 psi at an actual density of 45 pcf. The results of this panel manufacture are discussed in greater detail below.

Example 2 (Present Invention)

In this example, wood composite boards were prepared according to the present invention, with a three step preheating/pressing schedule (compression, preheating, and ventilation/vacuum evacuation press). The composite boards were formed from Aspen species having nominal strand dimensions of 5.75 "×0.75 "×0.030" using a commercially available 6" disk strander. Fine components were screened out. The total yield of useful strands is about 97%. The aspen strands were then dried to target moisture content of 7%, and coated with separate spray applications of 5.5 wt % MDI resin and 1.5 wt %, by solids, of emulsion wax (58% concentration,). The strands were aligned using a disk orienter to form a mat wherein the strands are aligned in a single direction (the machine direction) in a single layer. (The target final dimensions of the pressed board to be prepared from this mat is 45 pcf with a dimension of 5'×9'×1.75'). Then, 1.5 g/ft$^2$ commercially available release agents are sprayed on top and bottom screens contacting the mat. Two PressMan® hot press probes are placed in the panel center to monitor the internal gas pressure of pressed panels during pre-heating and subsequently hot pressing. The strands were then pressed into wood composite boards using a laboratory scale press having top and bottom platens according to the pre-heating and pressing schedule listed in Table II, below.

The wood composite board were formed with the laboratory scale operated according to the following parameters and pressing schedule set forth in Table II.

TABLE II

| Elapsed Time (seconds) | Description | Steam Injection/Ventilation |
|---|---|---|
| 10 | mat of wood composite material having height of 12.5 inches is formed | — |
| 38 | steam is injected | Injection at 30 psi |
| 5 | Press opened to 7 inches | Ventilation |
| 24 | Press closing | Ventilation |
| 660 | Cooking Panels in Press at 200° C. | — |
| 60 | Degas | — |

The highest core layer internal gas pressure for the pressed panels manufactured according to the present invention was between 12 psi (actual board density 45 pcf), considerably less than the 20 psi internal gas pressure measured during the prior art manufacturing process described in Example 1 above. As a result of this significantly lower gas pressure, no panel blowing was observed in the panels prepared according to the present invention, while some panels prepared according to the prior art did show panel blowing imperfections. Further visual and physical inspection indicated that imperfections such as pitting and blistering were also found in the panels prepared according to the prior art. By contrast, the panels prepared according to the present invention, utilizing a ventilation step, showed no such imperfections.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A method for the production of a wood composite board comprising the steps of:

providing a quantity of wood in the form of strands;

coating the wood strands with a binder composition to form coated strands;

forming a mat from the coated strands;

exposing said mat to steam wherein the exposing to steam is effective to raise the temperature of the mat but not completely cure the mat;

ventilating the steam subsequently to cessation of steam exposure in a manner effective to remove at least a portion of any condensed water and entrapped air in the mat and is completed before a following pressing step; and pressing the mat, at a high temperature, to form the wood composite board having a final thickness.

2. The method according to claim 1, wherein the high temperature is from about 175° C. to about 260° C.

3. The method according to claim 1, wherein the mat is formed from alternating layers, with the coated strands in adjacent layers being oriented substantially perpendicular to each other.

4. The method according to claim 1, wherein the mat is formed from layers, wherein in each layer the strands are aligned in substantially the same direction.

5. The method according to claim 1, wherein the ventilating step occurs immediately after the steam exposing step.

6. The method according to claim 1, wherein the final thickness of the wood composite board after pressing is from about 0.25 inch to about 5.5 inches, preferably about 1.5 inch to about 3.5 inch, more preferably about 1.75 inch to 2.5 inch.

7. The method according to claim 1, wherein the method further comprises a step, after the forming step, of prepressing the mat to a height of 110% to 300% of the final thickness of the wood composite board.

8. The method according to claim 1, wherein the method further comprises a step, after the forming step, of prepressing the mat to a density of about 5 pcf to about 25 pcf.

9. The method according to claim 1, wherein the steam exposing step causes a temperature increase in the mat, the amount of the temperature increase being from about 30° C. to about 110° C.

10. The method according to claim 1, wherein the wood composite board has a density of about 35 lbs/ft$^3$ to about 50 lbs/ft$^3$.

11. The method according to claim 1, wherein the binder composition concentration is from about 3 wt % to about 8 wt %.

12. The method according to claim 1, wherein the binder composition comprises about 0.1 wt % to about 3 wt % of wood composite additives.

* * * * *